United States Patent [19]

Momose et al.

[11] Patent Number: 4,708,639

[45] Date of Patent: Nov. 24, 1987

[54] COMBUSTOR FOR EXTERNAL COMBUSTION ENGINE HAVING ROTARY-TYPE REGENERATOR HEAT EXCHANGER

[75] Inventors: Yutaka Momose, Anjyo; Akira Yamaguro, Chiryu, both of Japan

[73] Assignee: Aisin Seiki Kabushiki Kaisha, Kariya, Japan

[21] Appl. No.: 929,394

[22] Filed: Nov. 12, 1986

[30] Foreign Application Priority Data

Nov. 14, 1985 [JP] Japan ..... 60-255620
Nov. 14, 1985 [JP] Japan ..... 60-255621

[51] Int. Cl.[4] ..... F23D 11/44; F23L 15/02; F02G 1/057

[52] U.S. Cl. ..... 431/215; 165/7; 165/9; 60/526

[58] Field of Search ..... 431/215, 164; 432/179, 432/180; 165/7, 8, 9; 60/39.5, 39.511, 39.512, 517, 526

[56] References Cited

U.S. PATENT DOCUMENTS

| | | | |
|---|---|---|---|
| 2,055,071 | 9/1936 | Eriksson | 165/9 |
| 2,738,958 | 3/1956 | Hodge | 165/7 |
| 3,372,735 | 3/1968 | Meijer | 165/9 |
| 3,811,497 | 5/1974 | Meijer et al. | 432/179 X |
| 3,861,146 | 1/1975 | Lynch et al. | 60/526 X |
| 3,898,841 | 8/1975 | Kanzler et al. | 60/526 X |

FOREIGN PATENT DOCUMENTS

| | | |
|---|---|---|
| 1113533 | 9/1961 | Fed. Rep. of Germany . |
| 2126062 | 5/1971 | Fed. Rep. of Germany . |
| 2707781 | 2/1977 | Fed. Rep. of Germany . |
| 61-23853 | 1/1986 | Japan . |

OTHER PUBLICATIONS

European Search Report dated Mar. 23, 1987.

*Primary Examiner*—Margaret A. Focarino
*Attorney, Agent, or Firm*—Burns, Doane, Swecker & Mathis

[57] ABSTRACT

A combustor for use in an external combustion engine having a rotary-type regenerator heat exchanger includes a housing having a combustion chamber, an air chamber, a plurality of first outlet ports, and a first inlet port. A main partition defining the combustion chamber and the air chamber in the housing has a plurality of second outlet ports defined in a peripheral portion thereof and a second inlet port defined in a central portion thereof. An annular regenerator is rotatably supported in the housing, dividing the air chamber into first and second chambers, the regenerator having first and second axially opposite end surfaces and a multiplicity of axial through-holes extending therebetween. First subpartitions define first outlet passages communicating between the first outlet ports, respectively, and the first end surface of the regenerator, and divide the first chamber into air and exhaust sections. Second subpartitions define second outlet passages communicating between the second outlet ports, respectively, and the second end surface of the regenerator, and divide the second chamber into air and exhaust sections.

6 Claims, 5 Drawing Figures

COMBUSTOR FOR EXTERNAL COMBUSTION ENGINE HAVING ROTARY-TYPE REGENERATOR HEAT EXCHANGER

BACKGROUND OF THE INVENTION

1. Field of the invention

The present invention relates to a combustor for use in an external combustion engine having a rotary-type regenerator heat exchanger.

2. Description of the Prior Art

Conventional combustors for use in external combustion engines having rotary-type regenerator heat exchangers comprise a combustion chamber defined in a housing and having heater pipes disposed on an inner circumference thereof over an angle of 360°, a ring-shaped regenerator rotatably supported in front of the combustion chamber and having a number of axial through holes, and air and exhaust chambers connected through the regenerator to the combustion chamber and defined in semicircular shapes. The regenerator serves to absorb the heat of a high-temperature exhaust gas discharged from the combustion chamber and to heat air introduced from the air chamber into the combustion chamber.

The regenerator includes a semicircular half portion normally positioned on the side of the exhaust chamber, with the other semicircular half portion normally positioned on the side of the air chamber. When the regenerator is rotated by a motor, it temporarily absorbs the heat of the exhaust gas from the exhaust chamber. Upon rotation of he regenerator to a 180°-position, the absorbed heat is radiated into an air flow utilized for combustion. Since the combustion air flow to be supplied into the combustion chamber is heated before it is actually delivered to the combustion chamber, the combustion efficiency in the combustion chamber is increased. However, inasmuch as one of the semicircular halves of the regenerator is positioned on the exhaust chamber side while the other semicircular half is on the air chamber side, the combustion gas in the combustion chamber that is of a transversely circular cross-sectional shape tends to flow out closer to the exhaust chamber side than its central area, and the flame within the combustion chamber fails to be uniformly spread from its center radially outwardly toward the circumference thereof through 360°. The heater pipes in the combustion chamber are subject to localized heating at portions thereof that are located in the direction in which the flame flows.

Seals are disposed between the housing and the opposite end surfaces of the heat regenerator body to provide hermetic sealing between these components. These seals are biased by springs in order to maintain the desired sealing capability even when the seals are worn. One problem with these seal springs is that they undergo thermally induced fatigue arising from exposure to the high-temperature exhaust gas, resulting in reduced resiliency and, hence, a reduction in the biasing force applied to bias the seals. This means that the desired excellent sealing ability cannot be maintained for a long period of time.

SUMMARY OF THE INVENTION

It is an object of the present invention to provide a combustor for use in an external combustion engine having a rotary-type regenerator heat exchanger, the combustor having an air chamber and outlet passages which are reliably separated by seals.

Another object of the present invention is to provide a combustor for use in an external combustion engine having a rotary-type regenerator heat exchanger, the combustor having angularly equally spaced outlet ports for allowing a high-temperature exhaust gas to be uniformly spread radially outwardly.

Still another object of the present invention is to provide a combustor for use in an external combustion engine having a rotary-type regenerator heat exchanger, the combustor having resilient means for resiliently pressing a heat regenerator body against seals, the resilient means being disposed for being cooled by air to be introduced into a combustion chamber.

According to the present invention, there is provided a combustor for use in an external combustion engine having a rotary-type regenerator heat exchanger, comprising: a housing having a combustion chamber, an air chamber, a plurality of first outlet ports, and a first inlet port; a main partition defining the combustion chamber and the air chamber in the housing and having a plurality of second outlet ports defined in a peripheral portion thereof and a second inlet port defined in a central portion thereof; an annular regenerator rotatably supported in the housing and dividing the air chamber into first and second chambers, the regenerator having first and second axially opposite end surfaces and a multiplicity of axial through-holes extending therebetween; first subpartitions defining first outlet passages communicating between the first outlet ports, respectively, and the first end surface of the regenerator, and dividing the first chamber into air and exhaust sections; and second subpartitions defining second outlet passages communicating between the second outlet ports, respectively, and the second end surface of the regenerator, and dividing the second chamber into air and exhaust sections.

Each of the first and second end surfaces of the regenerator has a peripheral edge portion and a central portion, the housing having a first peripheral edge support portion and a first central support portion which support the peripheral edge portion and the central portion of the first end surface, and a second peripheral edge support portion and a second central support portion which support the peripheral edge portion and the central portion of the second end surface. The combustor further includes seals disposed between the support portions of the housing and the regenerator.

The combustor or the first subpartitions further include resilient means interposed between the housing and one of the seals for resilient pressing the regenerator against the seals. The resilient means comprises a plurality of compression coil springs, or bellows disposed under compression between the housing and said one of the seals.

When the external combustion engine operates, fuel is injected from a fuel injection valve into the combustion chamber and is well mixed with combustion air introduced from the second inlet port. The injected fuel is then ignited by an igniter so as to be combusted in the combustion chamber to produce flames. After the heat has been transferred from the flames to heater pipes through heat radiation and convection, the flames or exhaust gas is delivered via the second outlet ports into the second outlet passages. At the same time, the regenerator is rotated by a motor through meshing gears. The exhaust gas is discharged through the through holes of the regenerator thus rotated and the first outlet passages out of the first outlet ports. When the regenerator which has been heated by the high-temperature exhaust gas as it passes through the regenerator reaches the first and second chambers of the air chamber, fresh air flows from the first inlet port through the holes of the regenerator into the second inlet port. Upon passage through the regenerator, the air flow is preheated by the heat from the regenerator before being introduced into the combustion chamber.

While the regenerator is in rotation, the peripheral edge portions of the first and second end surfaces of the regenerator are pressed by the circumferentially equally spaced coil springs against the seals disposed between the first and second peripheral edge support portions of the housing. The regenerator therefore keeps the air chamber hermetically separated from the first and second outlet passages. The regenerator is uniformly heated by the exhaust gas passing through the plural outlet passages.

The high-temperature gas produced as the flames by the combustion in the combustion chamber flows from the central portion of the combustion chamber so as to be spread radially outwardly toward the second outlet ports. Therefore, the flames generated upon fuel combustion are not localized but are substantially uniformly applied against the heater pipes, which are thus efffectively and uniformly heated without localized heat application. The springs or bellows for normally pressing the regenerator against the seals are not subjected to the heat of the exhaust gas since the springs are continuously cooled by low-temperature air before it is preheated by the regenerator. The gears for rotating the regenerator are also cooled by the low-temperature air. Consequently, the springs or bellows and the gears are prevented from undergoing thermally induced deterioration or fatigue.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
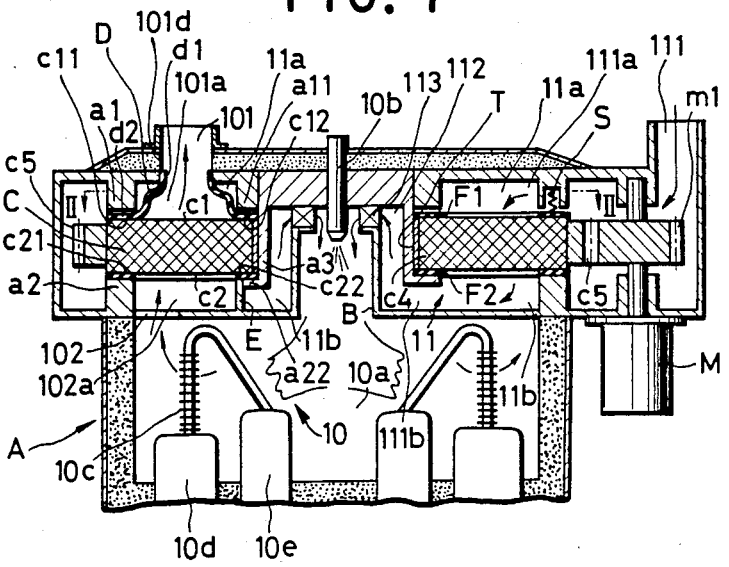
FIG. 1 is a cross-sectional view taken along line I—I of FIG. 2, showing a combustor according to an embodiment of the present invention.

Like or corresponding parts are denoted by like or corresponding reference characters throughout the views.

Figure 3:
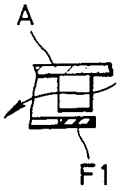
FIG. 3 is a cross-sectional view taken along line III—III of FIG. 2.
Figure 2:
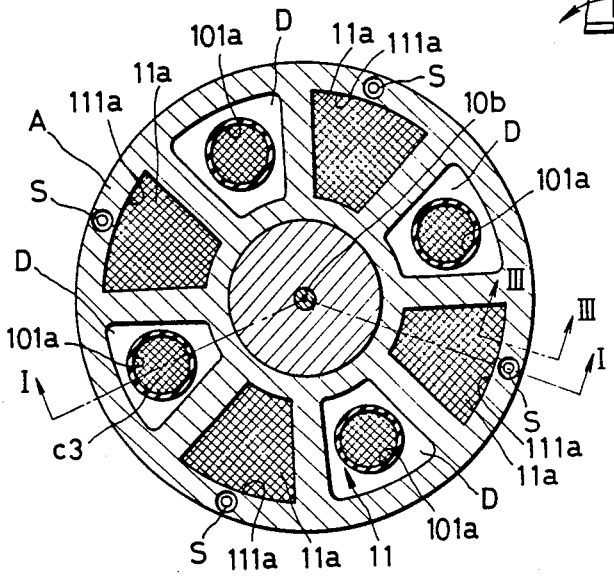
FIG. 2.is a cross-sectional view taken along line II—II of FIG. 1.

FIGS. 1 through 3 show a combustor according to an embodiment of the present invention for use in an external combustion engine having a rotary-type regenerator heat exchanger, for example, the Stirling engine.

The combustor generally comprises a housing A, a main partition B, a regenerator C, first sub-partitions D, and second partitions E.

The housing A has a combustion chamber 10, an air chamber 11, a plurality of first outlet ports 101, and a first inlet port 111. The housing A supports a fuel injection valve 10*b* projecting into the combustion chamber 10 for injecting fuel into a central portion 10*a* of the combustion chamber 10. Heater pipes 10*c* are arranged in the combustion chamber 10 at a peripheral area surrounding the central portion 10*a*. Each of the heater pipes 10*c* has one end connected to a compression chamber 10*d* and the other end to an expansion chamber 10*e*. The heater pipes 10*c*, the compression chambers 10*d*, and the expansion chambers 10*e* are filled with a working gas.

The main partition B defines the combustion chamber 10 and the air chamber 11 and has a plurality (four) of second outlet ports 102 defined at equal angular intervals in a peripheral portion thereof and a second inlet port 112 defined centrally in the main partition B. The second inlet port 112 has a swirler 113 for swirling an air flow which is introduced from the air chamber 11 into the combustion chamber 10, the second inlet port 112 opening above the central portion 10*a* of the combustion chamber 10.

The regenerator C divides the air chamber 11 into a first chamber 11*a* and a second chamber 11*b* and is rotatably supported in the housing A. The regenerator C has a multiplicity of axial through-holes c3. The regenerator C is of a thick annular shape and may be in the form of a honeycomb made of structural ceramics. The regenerator C also has an axial central through-hole defined in a central portion c4 thereof. The regenerator C includes a first end surface c1 having a peripheral edge portion c11, and a second end surface c2 having a peripheral edge portion c21. The central portion c4 and the peripheral edge portions c11 of the regenerator C are supported by a first peripheral edge support portion a1 and a first central support portion all of the housing A. The central portion c4 and the peripheral edge portion c21 of the regenerator C are supported by a second peripheral edge support portion a2 and a second central support portion a22 of the housing A. Seals F1, F2 are disposed between the peripheral edge support portions a1, a2 and the regenerator C. The seal F1 defines, in the circumferential direction through 360°, portions of first outlet passages 101*a* and portions of first air passages 111*a*. The seal F2 alternately defines, in the circumferential direction through 360°, portions of second outlet passages 102*a* and portions of second air passages 111*b*.

A driven gear c5 is fixedly mounted on the outer circumferential surface of the regenerator C and held in mesh with a driver gear ml rotatably supported in the vicinity of the first inlet port 111. The driver gear m1 is coupled to a motor M for being driven thereby. Compression coil springs S are disposed in the first chamber 11*a* of the air chamber 11 for normally urging the regenerator C resiliently against the seals F1, F2 interposed between the housing A and the regenerator C, the coil springs S being positioned at the peripheral edge portion of the regenerator C at circumferentially equally spaced intervals. The regenerator C is loosely fitted over a central support portion a3 of the housing A with a cylindrical bushing T interposed therebetween.

The first subpartitions D are disposed at cirmferentially equally spaced locations in the housing A. The first subpartitions D have cylindrical ends d1 coupled to inner peripheries of the first outlet ports 101 and opposite cylindrical ends d2 coupled to the seal F1, thus defining the first outlet passages 101*a* which communicate between the first outlet ports 101 and the first end surface c1 of the regenerator C and dividing the first chamber 11*a* into air and exhaust sections.

The second partitions E define second outlet passages 102*a* which communicate between the second end surface c2 of the regenerator C and the outlet ports 102, dividing the second chamber 11*b* into air and exhaust sections.

The first outlet passages 101*a* extend from the first end surface c1 of the regenerator C to the first outlet ports 101, and the second outlet passages 102*a* extend from the second outlet ports 102*a* to the second end surface c2 of the regenerator C. The first air passages 111*a* extend from the first air inlet port 111 through the first chamber 11*a* to the first end surface c1 of the regenerator C. The second air passage 111*b* extends from the second end surface c2 of the regenerator C to the second inlet port 112.

Operation of the combustor thus constructed will be described below.

As the external combustion engine operates, fuel injected from the fuel injection valve 10*b* into the combustion chamber 10 is well mixed with combustion air introduced from the second inlet port 112 and swirled by the swirler 113, and is then ignited by an igniter (not shown) so as to be combusted in the combustion chamber 10 to produce flames. After the heat has been transferred from the flames to the heater pipes 10*c* through heat radiation and convection, the flames or exhaust gas is delivered via the second outlet ports 102 into the second outlet passages 102*a*. At the same time, the motor M is energized to rotate the driver gear m1 to cause the driven gear c5 meshing therewith to rotate the regenerator C. The exhaust gas is discharged through the through-holes c3 of the regenerator C thus rotated and the first outlet passages 101*a* out of the first outlet ports 101. When the regenerator C which has been heated by the high-temperature exhaust gas as it passes through the regenerator C reaches the first and second chambers 11*a*, 11*b* of the air chamber 11, fresh air flows from the first inlet port 111 through the holes c3 of the regenerator C into the second inlet port 112. Upon passage through the regenerator C, the air flow is preheated by the heat from the regenerator C before being introduced into the combustion chamber 10.

While the regenerator C is in rotation, the peripheral edge portions c11, c21 of the first and second end surfaces c1, c2 of the regenerator C are pressed by the circumferentially equally spaced coil springs S against the seals F1, F2 disposed between the first and second peripheral edge portions a1, a2 of the housing A. The regenerator C therefore keeps the air chamber 11 hermetically separated from the first and second outlet passages 101*a*, 102*a*. The regenerator C is uniformly heated by the exhaust gas passing through the plural outlet passages.

The high-temperature gas produced as the flames by the combustion in the combustion chamber 10 flows from the central portion 10*a* of the combustion chamber 10 so as to be spread radially outwardly toward the second outlet ports 102. Therefore, the flames generated upon fuel combustion are not localized, but are substantially uniformly applied against the heater pipes 10*c*, which are thus efffectively and uniformly heated without localized heat application. The springs S for normally pressing the regenerator C against the seals F1, F2 are not subjected to the heat of the exhaust gas since the springs S are continuously cooled by low-temperature air before it is preheated by the regenerator C. The gears c5, m1 for rotating the regenerator C are also cooled by the low-temperature air. Consequently, the springs S and the gears c5, m1 are prevented from undergoing thermally induced deterioration or fatigue.

Figure 4:
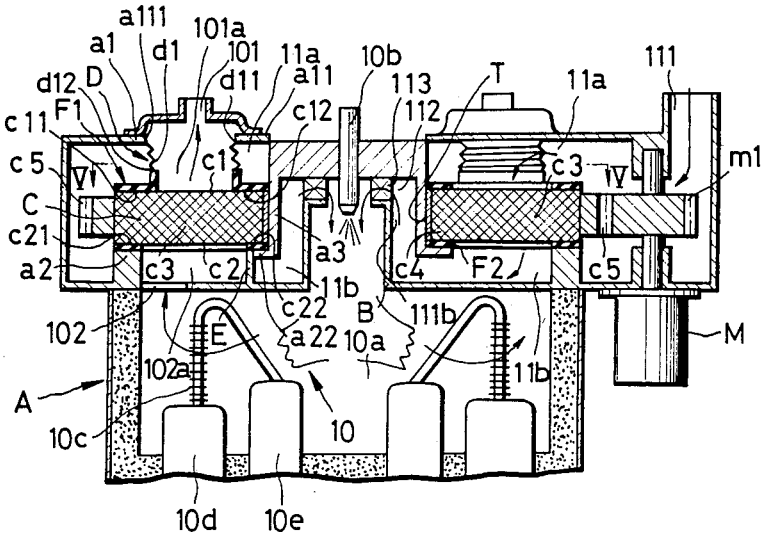
FIG. 4 is a cross-sectional view taken along line IV—IV of FIG. 5, showing a combustor according to another embodiment of the present invention.
Figure 5:
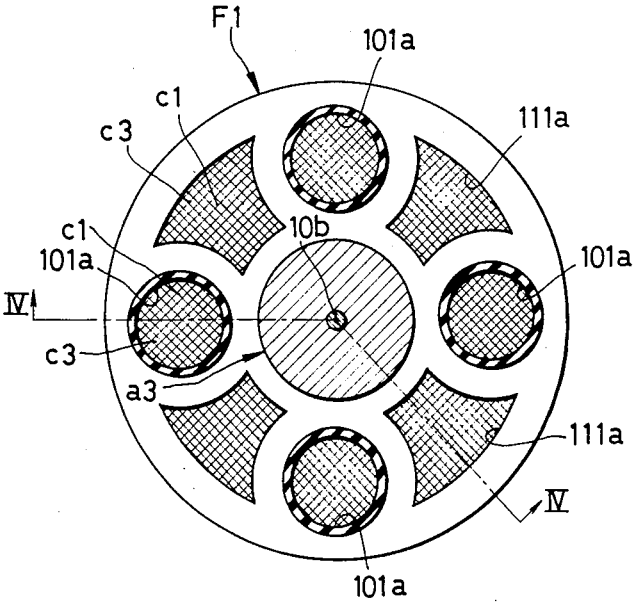
FIG. 5 is a cross-sectional view taken along line V—V of FIG. 4.

FIGS. 4 and 5 illustrate a combustor according to another embodiment of the present invention. Since the combustor shown in FIGS. 4 and 5 is similar to the combustor of FIGS. 1 through 3, only those components which are different from those of FIGS. 1 through 3 will be described in detail.

The first subpartitions D and the seal F1 are disposed between the regenerator C and the peripheral edge support portions a1, a2 of the housing A.

The seal F1 is held against the first peripheral edge portion c11 and the central portion c4 of the first end surface c1 of the regenerator C. The first subpartitions D defining the first outlet passages 101*a* include resilient portions d1 in the form of bellows defining the first outlet passages 101*a* therein and having cylindrical ends d11 coupled to inner peripheries of the first outlet ports 101 and opposite cylindrical ends d12 coupled to the seal F1. The resilient portions d1 are held under compression between the housing A and the seal F1 for resiliently pressing the seal F1 against the peripheral edge portion c11 and the central portion c4 of the first end surface c1 of the regenerator C, and hence for resiliently pressing the peripheral edge portion c22 and the central portion c4 of the second end surface c2 against the seal F2.

During rotation of the regenerator C, the peripheral edge portions c11, c21 of the first and second end surfaces c1, c2 of the regenerator C are pressed by the circumferentially equally spaced resilient portions d1 against the seals F1, F2 disposed between the first and second peripheral edge support portions a1, a2 of the housing A, so that the regenerator C therefore keeps the air chamber 11 hermetically separated from the first and second outlet passages 101*a*, 102*a*.

Since the resilient portions d1 are located on the side of the first end surface c1 of the regenerator C where the exhaust gas is of a low temperature, the resilient portions d1 are prevented from being thermally affected by the exhaust gas that has passed through the regenerator C. In particular, the outer peripheral surfaces of the resilient portions d1 are usually cooled by fresh air since they are exposed to a low-temperature air flow before it enters and is heated by the regenerator C. Therefore, the first subpartitions D and the first chamber 11*a* always remain cooled to prevent the resilient portions d1 and the gears c5, ml from being thermally deteriorated or fatigued.

As many apparently widely different embodiments of the present invention can be made without departing from the spirit and scope thereof, it is to be understood that the invention is not limited to the specific embodiments thereof except as defined in the appended claims.

What is claimed is:

1. A combustor for use in an external combustion engine having a rotary-type regenerator heat exchanger, comprising:

a housing having a combustion chamber, an air chamber, a plurality of first outlet ports, and a first inlet port;

a main partition defining said combustion chamber and said air chamber in said housing and having a plurality of second outlet ports defined in a peripheral portion thereof and a second inlet port defined in a central portion thereof;

an annular regenerator rotatably supported in said housing and dividing said air chamber into first and second chambers, said regenerator having first and second axially opposite end surfaces and a multiplicity of axial through-holes extending therebetween;

first subpartitions defining first outlet passages communicating between said first outlet ports, respectively, and said first end surface of said regenerator, and dividing said first chamber into air and exhaust sections; and second subpartitions defining second outlet passages communicating between said second outlet ports, respectively, and said second end surface of said regenerator, and dividing said second chamber into air and exhaust sections.

2. The combustor according to claim 1, wherein each of said first and second end surfaces of said regenerator has a peripheral edge portion and a central portion, said housing having a first peripheral edge support portion and a first central support portion which support said peripheral edge portion and said central portion of said first end surface, and a second peripheral edge support portion and a second central support portion which support said peripheral edge portion and said central portion of said second end surface, said combustor further including seals disposed between said support portions of said housing and said regenerator.

3. The combustor according to claim 2, further including resilient means interposed between said housing and one of said seals for resiliently pressing said regenerator against said seals.

4. The combustor according to claim 3, wherein said resilient means comprises a plurality of compression coil springs.

5. The combustor according to claim 1, wherein said first subpartitions include resilient means interposed between said housing and one of said seals for resiliently pressing said regenerator against said seals.

6. A combustor according to claim 5, wherein said resilient means comprises bellows disposed under compression between said housing and said one of the seals.

* * * * *